US008559853B2

(12) United States Patent
Tsunoda

(10) Patent No.: US 8,559,853 B2
(45) Date of Patent: Oct. 15, 2013

(54) IMAGE FORMING APPARATUS WITH DIFFERENT PRESSING FORCES BETWEEN IMAGE CARRIERS AND DEVELOPER CARRIERS

(75) Inventor: Arihiro Tsunoda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 241 days.

(21) Appl. No.: 12/958,831

(22) Filed: Dec. 2, 2010

(65) Prior Publication Data

US 2012/0033995 A1 Feb. 9, 2012

(30) Foreign Application Priority Data

Dec. 11, 2009 (JP) ..... 2009-281968

(51) Int. Cl.
*G03G 15/01* (2006.01)

(52) U.S. Cl.
USPC ..... 399/223; 399/53; 399/55; 399/279

(58) Field of Classification Search
USPC ..... 399/53, 55, 223, 264, 279, 350
See application file for complete search history.

(56) References Cited

U.S. PATENT DOCUMENTS

| | | | | |
|---|---|---|---|---|
| 7,022,447 | B2 * | 4/2006 | Miyakawa | 430/108.6 |
| 2003/0007808 | A1 * | 1/2003 | Hiroki | 399/228 |
| 2003/0215266 | A1 * | 11/2003 | Ishida et al. | 399/223 |
| 2005/0141909 | A1 * | 6/2005 | Takahashi et al. | 399/53 |
| 2011/0097656 | A1 * | 4/2011 | Mizobe | 430/105 |
| 2011/0164900 | A1 * | 7/2011 | Onishi | 399/223 |

FOREIGN PATENT DOCUMENTS

| | | | |
|---|---|---|---|
| JP | 09-015930 | A | 1/1997 |
| JP | 11-052705 | A | 2/1999 |
| JP | 2004-110011 | A | 4/2004 |
| JP | 2005-331567 | A | 12/2005 |
| JP | 2007-121775 | A | 5/2007 |
| JP | 2007-256352 | A | 10/2007 |
| JP | 2007-322833 | A | 12/2007 |

* cited by examiner

*Primary Examiner* — David Gray
*Assistant Examiner* — Francis Gray
(74) *Attorney, Agent, or Firm* — Marvin A. Motsenbocker; Mots Law, PLLC

(57) ABSTRACT

Various methods, devices and techniques for improving image quality for an image forming device are disclosed. For example, improved image quality can be had for an image forming apparatus having a first image forming unit including a first image carrier and a first developer carrier in contact with the first image carrier at a first pressure, and the first image carrier carries a first developer having a first charging characteristic, and a second image forming unit including a second image carrier, and a second developer carrier in contact with the second image carrier at a second pressure, greater than the first pressure, and the second developer carrier carries a second developer having a second charging characteristic. The first pressure and the second pressure are preset based on the first charging characteristic and the second charging characteristic.

12 Claims, 14 Drawing Sheets

| NUMBER OF PRINTED SHEETS | 0 | 1000 | 2000 |
|---|---|---|---|
| PRESSING FORCE [0.5N] | 75 | 85 | 90 |
| PRESSING FORCE [0.7N] | 77 | 87 | 96 |
| PRESSING FORCE [0.9N] | 80 | 92.5 | 105 |
| PRESSING FORCE [1.1N] | 81 | 97 | 120 |
| PRESSING FORCE [1.3N] | 85 | 106 | 132 |
| LOWER END OF DIRT RANGE | 110 | 110 | 110 |

| NUMBER OF PRINTED SHEETS | 0 | 1000 | 2000 |
|---|---|---|---|
| PRESSING FORCE [0.5N] | 75 | 85 | 90 |
| PRESSING FORCE [0.7N] | 77 | 87 | 96 |
| PRESSING FORCE [0.9N] | 80 | 92.5 | 105 |
| PRESSING FORCE [1.1N] | 81 | 97 | 120 |
| PRESSING FORCE [1.3N] | 85 | 106 | 132 |
| LOWER END OF DIRT RANGE | 110 | 110 | 110 |

| | CYAN IMAGE FORMING UNIT | | BLACK IMAGE FORMING UNIT | |
|---|---|---|---|---|
| PRESSING FORCE [N] | COLOR DIFFERENCE [δE] | TONER VOLTAGE [V] | COLOR DIFFERENCE[δE] | TONER VOLTAGE [V] |
| 0.5 | 1.88 | 40.2 | 1.22 | 70.0 |
| 0.7 | 1.60 | 42.0 | 1.00 | 73.0 |
| 0.9 | 1.01 | 45.2 | 0.80 | 80.0 |
| 1.1 | 0.90 | 47.0 | 0.72 | 81.0 |
| 1.3 | 0.88 | 50.0 | 0.70 | 85.0 |

| | DEGREE OF HARDNESS 77[°] | | DEGREE OF HARDNESS 78[°] | | DEGREE OF HARDNESS 79[°] | |
|---|---|---|---|---|---|---|
| PRESSING FORCE [N] | COLOR DIFFERENCE [ΔE] | TONER VOLTAGE [V] | COLOR DIFFERENCE [ΔE] | TONER VOLTAGE [V] | COLOR DIFFERENCE [ΔE] | TONER VOLTAGE [V] |
| 0.5 | 1.88 | 40.2 | 1.55 | 42.0 | 1.30 | 44.0 |
| 0.7 | 1.60 | 42.0 | 1.23 | 46.0 | 1.10 | 48.0 |
| 0.9 | 1.01 | 45.2 | 0.90 | 48.0 | 0.80 | 50.0 |
| 1.1 | 0.90 | 47.0 | 0.80 | 52.0 | 0.72 | 56.0 |
| 1.3 | 0.88 | 50.0 | 0.70 | 56.0 | 0.60 | 60.0 |

IMAGE FORMING APPARATUS WITH DIFFERENT PRESSING FORCES BETWEEN IMAGE CARRIERS AND DEVELOPER CARRIERS

CROSS REFERENCE TO RELATED APPLICATIONS

This application claims priority based on 35 USC 119 from prior Japanese Patent Application No. P2009-281968 filed on Dec. 11, 2009, entitled "Image Processing Apparatus", the entire contents of which are incorporated herein by reference.

BACKGROUND OF THE INVENTION

1. Field of the Invention

The invention relates to an image forming apparatus.

2. Description of Related Art

A conventional image forming apparatus such as a printer, a copier, a facsimile, or a multi-function device, for example, a color printer is provided with image forming units (developing units) for respective colors of black, yellow, magenta and cyan. In each image forming unit, the surface of a photoconductive drum is charged by a charging roller, then is exposed to light from an LED head to form an electrostatic latent image. A thin layer of toner formed on a developing roller electrostatically adheres to the electrostatic latent image on the photoconductive drum, so that a toner image is formed thereon. Then, the color toner images on the respective photoconductive drums of the image forming units are sequentially transferred to a sheet by transfer rollers and are thus superimposed on the sheet, so that a color toner image is formed on the sheet. The color toner image is fixed on the sheet by a fixing unit to form a color image thereon. Remaining toner on each photoconductive drum after the transfer is scraped off and removed by a cleaning blade.

In each image forming unit, as the toner on the developing roller adheres to the electrostatic latent image formed on the photoconductive drum, the developing roller is designed to be pressed to the photoconductive drum by predetermined pressure force (see, for example, Japanese Patent Application Laid-Open No. 2005-331567).

SUMMARY OF THE INVENTION

In the conventional color printer, however, if the pressure forces applied in the image forming units are the same, the quality of the resultant image may be degraded.

An object of an aspect of the invention is to improve the image quality.

An aspect of the invention is an image forming device including: a first image forming unit including an image carrier and a developer carrier which is in contact with the image carrier with a first pressure, and carries a first developer on the developer carrier; and a second image forming unit including an image carrier, and a developer carrier which is in contact with the image carrier with a second pressure greater than the first pressure, and carries a second developer on the developer carrier.

According to the aspect of the invention, the quality of the image is improved.

DETAILED DESCRIPTION OF EMBODIMENTS

Figure 1:
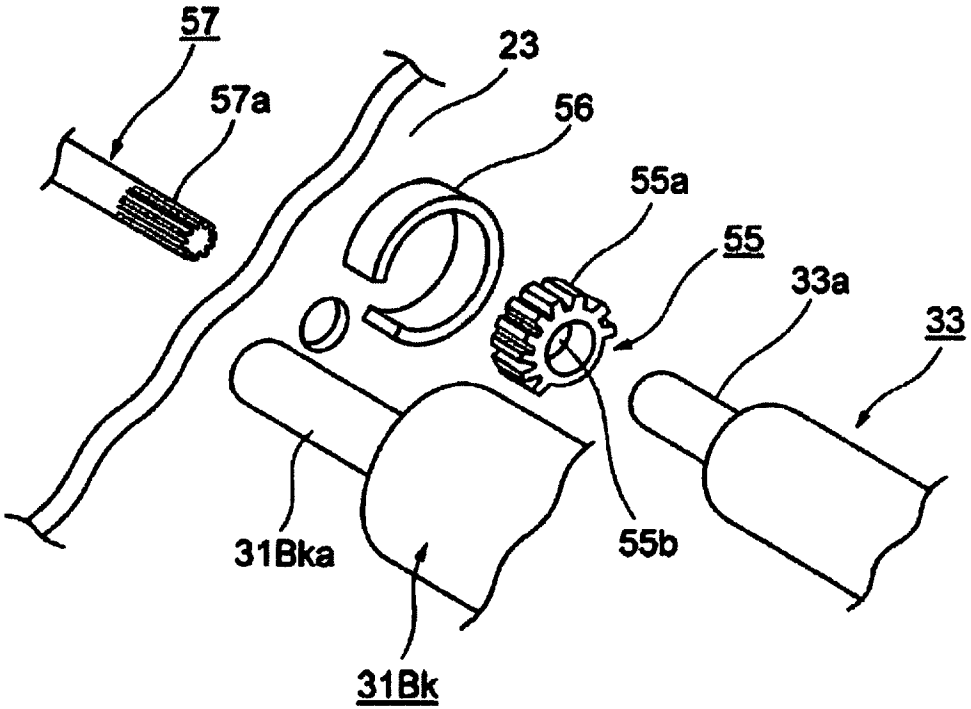
FIG. 1 is an illustrative diagram of a pressing force adjustment mechanism in a first embodiment of the invention.

Descriptions are provided herein below for embodiments based on the drawings. In the respective drawings referenced herein, the same constituents are designated by the same reference numerals and duplicate explanation concerning the same constituents is omitted. All of the drawings are provided to illustrate the respective examples only.

In the following, a color printer as an image forming device is described.

[First Embodiment]

Figure 2:
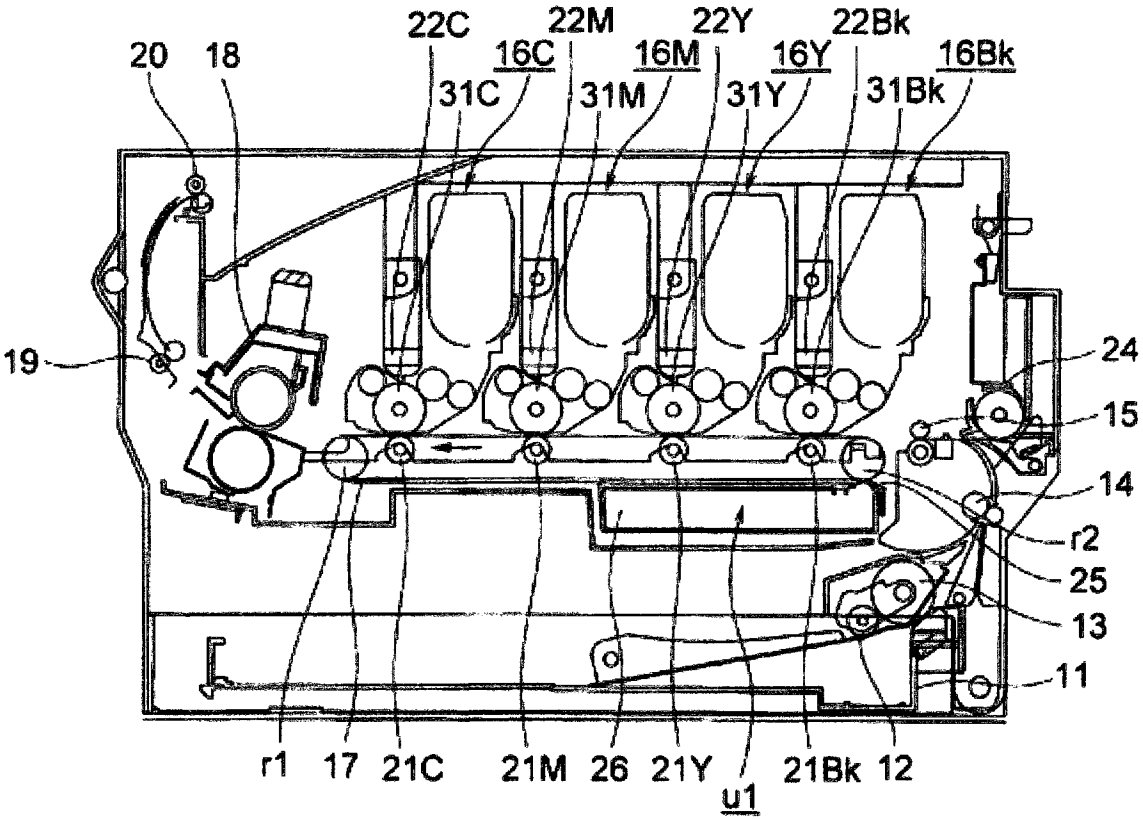
FIG. 2 is a schematic diagram of a color printer in the first embodiment of the invention.

FIG. 2 is a schematic diagram of a color printer in a first embodiment of the invention.

As shown in FIG. 2, sheet cassette 11 as a medium storage unit is disposed at a lower section of the color printer, and sheets (not shown) as media are stored in sheet cassette 11. A sheet feeding mechanism, which feeds each sheet individually, is disposed adjacent to the front end of sheet cassette 11. The sheet feeding mechanism includes feed roller 12 and separation roller 13. A sheet fed by the sheet feeding mechanism is sent to transport roller 14 disposed above the sheet feeding mechanism, and is further sent to transport roller 15 to correct skew of the sheet. After skew of the sheet is corrected, the sheet is sent to image forming units (developing devices: imaging drums) 16Bk, 16Y, 16M, 16C which are configured to form images in respective colors of black, yellow, magenta, and cyan. Image forming units 16Bk, 16Y, 16M, 16C are disposed sequentially in this order from upstream in the sheet transporting direction.

Image forming units 16Bk, 16Y, 16M, 16C are respectively provided with: photoconductive drums 31Bk, 31Y, 31M, 31C as image carriers, and LED heads 22Bk, 22Y, 22M, 22C, as exposure devices, each configured to form an electrostatic latent image on the surface of the respective photoconductive drums 31Bk, 31Y, 31M, 31C by exposing the surface (erasing electric charge of exposed portions). LED heads 22Bk, 22Y, 22M, 22C, are disposed adjacent to respective image forming units 16Bk, 16Y, 16M, 16C, and opposed to respective photoconductive drums 31Bk, 31Y, 31M, 31C.

Transfer unit u1 is disposed along image forming units 16Bk, 16Y, 16M, 16C, and transfer unit u1 includes drive roller r1 as a first roller, driven roller r2 as a second roller, transfer belt 17 as a transport member movably stretched by drive roller r1 and driven roller r2, and transfer rollers 21Bk, 21Y, 21M, 21C as transfer members disposed opposed to respective photoconductive drums 31Bk, 31Y, 31M, 31C. Transfer belt 17 and transfer rollers 21Bk, 21Y, 21M, 21C are connected to a power supply for transfer (not shown), and a predetermined voltage is applied to the transfer rollers.

The sheet is transported as transfer belt 17 moves, and is passed between image forming units 16Bk, 16Y, 16M, 16C and transfer rollers 21Bk, 21Y, 21M, 21C, and toner images as developer images of respective colors which are formed in image forming units 16Bk, 16Y, 16M, 16C are sequentially superimposed and transferred by transfer rollers 21Bk, 21Y, 21M, 21C so that a color toner image is formed.

Subsequently, the sheet is sent to fixing unit 18 as a fixing device, and the color toner image is fixed therein so that a color image is formed. The sheet, after being ejected from fixing unit 18, is transported by transport roller 19, and is made to exit out of the printer by exit roller 20.

Here, component 24 is a temperature and humidity sensor as an environmental condition detector, and temperature and humidity sensor 24 detects temperature and humidity which are environmental conditions in the color printer in order to change the voltage of a power supply (not shown) for development or a control table of fixing unit 18. Also, component 25 is a cleaning blade as a first cleaning member configured to scrape off the toner as a developer, which adheres to transfer belt 17. The toner scraped off by cleaning blade 25 is collected in waste toner box 26 as a first developer collection container.

Toner of each of the colors is stored in each toner cartridge as a developer container (not shown) of each of image forming units 16Bk, 16Y, 16M, 16C. In this case, pulverized toner (for example, volume average particle diameter of 5.7 [nm]) is used as toner of each of the colors, and the toner is made of raw material that is different for each color. That is to say, carbon black which is a black pigment is used for black toner, a pigment such as isoindoline and quinophthalone is used for yellow toner, a pigment such as quinacridone and carmine is used for magenta toner, and a pigment having characteristics of being transparent to near-infrared light such as copper phthalocyanine and anthraquinone is used for cyan toner.

Also, the toner can be formed by adding an external additive, whose particle diameter is 5 [nm] or more and 50 [nm] or less, to the base toner (toner mother particles) that is formed by dispersing a pigment, charge control agent, and the like in a binding resin such as a polyester resin, a styrene acrylic copolymer, and the like.

A first image forming unit is defined as a predetermined image forming unit out of image forming units 16Bk, 16Y, 16M, 16C (for example, black image forming unit 16Bk), and a second image forming unit is defined as another one of the predetermined image forming units (for example, image forming units 16Y, 16M, 16C for yellow, magenta, cyan, respectively). Also, a first developer is defined by the toner (for example, black toner) used for the first image forming unit (for example, black image forming unit 16Bk), and a second developer different from the first developer is defined by the toner (for example, yellow, magenta, and cyan toner) used for the second image forming unit (for example, image forming units 16Y, 16M, 16C for yellow, magenta, cyan, respectively).

Next, a control device of the color printer is described.

The control device which is not shown includes: a print controller as a main controller configured by a CPU (microprocessor) as an arithmetic unit, a ROM as a first storage device, a RAM as a second storage device, an input/output port, and a timer as a time counter; an interface (I/F) controller to control the entire sequence of the color printer to perform print operations in accordance with print data and control commands received from a host computer as an upper-level device; a reception memory as a reception data storage configured to temporarily record the print data that is input via the interface controller; an image data editing memory as an image data storage that receives the print data recorded in the reception memory and also records pictorial data, i.e., the image data formed by editing the print data; and a display to display a state of the color printer. The control device further includes: a manipulator provided with switches as a manipulator to send operator's instructions to the print controller; various kinds of sensors to monitor operating conditions of the color printer (for example, a sheet position detection sensor as a medium detector, temperature and humidity sensor 24, a density sensor as a density detector); a power supply; a head drive controller to send the image data recorded in the image data editing memory to LED heads 22Bk, 22Y, 22M, 22C and drive LED heads 22Bk, 22Y, 22M, 22C; a fixing controller to apply a voltage to fixing unit 18; a transport controller to control a sheet transport motor for transporting sheets; and a drive controller to drive a drive motor for rotating photoconductive drums 31Bk, 31Y, 31M, 31C.

Next, image forming units 16Bk, 16Y, 16M, 16C are described. Because the structures of image forming units 16Bk, 16Y, 16M, 16C are the same, black image forming unit 16Bk only is described.

Figure 3:
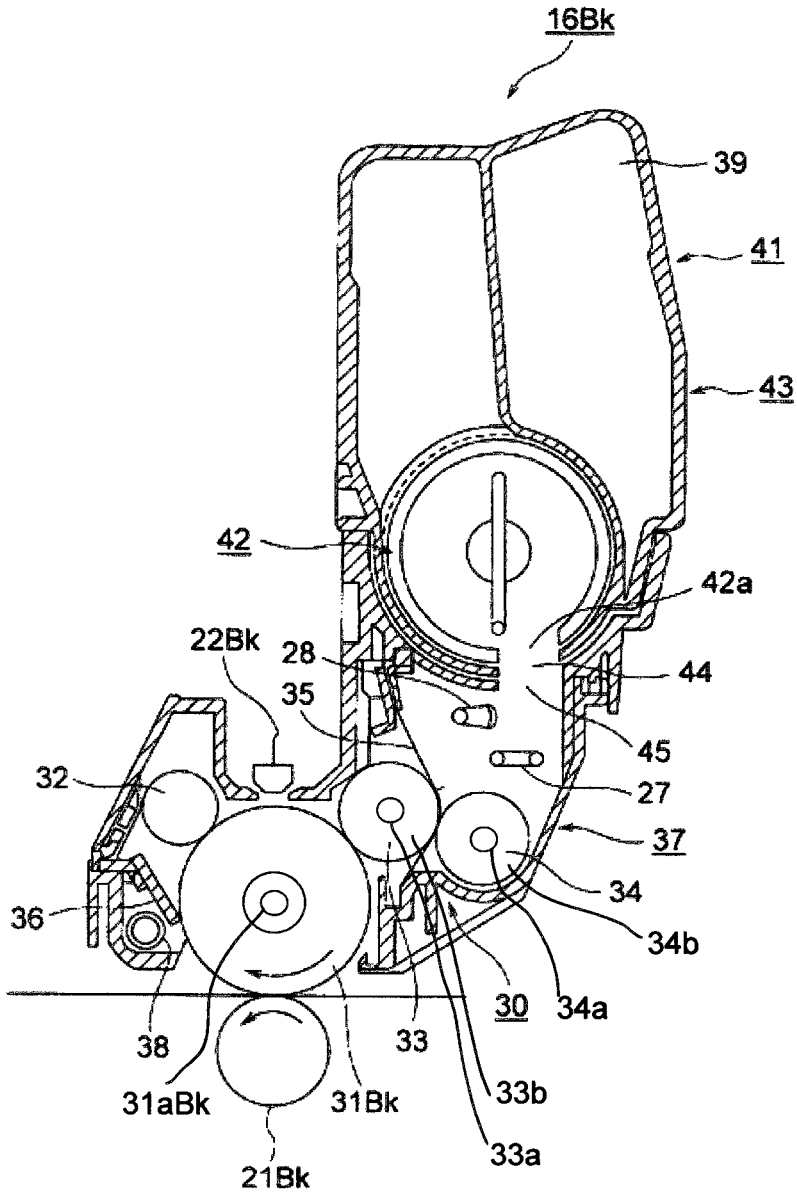
FIG. 3 is a schematic diagram of an image forming unit in the first embodiment of the invention.

FIG. 3 is a schematic diagram of an image forming unit in a first embodiment of the invention.

As shown in the figure, in image forming unit 16Bk, toner cartridge 41, in which toner is stored, is detachably disposed on the main body of image forming unit 16Bk, i.e., image forming unit main body 37, and toner is supplied from toner cartridge 41 to developing unit 30 disposed in image forming unit main body 37.

Thus, toner supply port 44 as a developer supply port is formed on the undersurface of case 43 as a developer container in toner cartridge 41, and shutter 42 as an opening and closing member is movably disposed, specifically in this embodiment, rotatably disposed to open and close toner supply port 44. Opening 42*a* is formed in shutter 42, and toner supply port 44 can be opened by operating an operation lever (not shown) as a manipulator formed integrally with shutter 42 so as to rotate shutter 42 to match toner supply port 44 and opening 42*a*. Also, toner supply port 44 can be closed by operating the operation lever so as to rotate shutter 42 to displace opening 42*a* from toner supply port 44 position.

In image forming unit main body 37, a mounting surface including a concave side is formed to mount toner cartridge 41, and toner replenishment port 45 as a developer replenishment port is formed so as to be aligned with toner supply port 44 on the mounting surface. Therefore, when toner supply port 44 is opened, the toner in toner cartridge 41 is supplied into image forming unit main body 37 through toner replenishment port 45.

Image forming unit 16Bk is connected to photoconductive drum 31Bk and a power supply for charging (not shown), and includes: charging roller 32 as a charging device to which a predetermined voltage is applied to uniformly charge the surface of photoconductive drum 31Bk; developing unit 30; and a cleaning device configured to remove the toner remaining on photoconductive drum 31Bk by scraping off the same after transfer of the toner image, to collect the toner as waste toner, and then to send the toner to waste toner storage container 39 as a second developer collection container disposed in toner cartridge 41.

Developing unit 30 includes: stirring member 28 which is rotated to stir the toner supplied from toner cartridge 41; toner stirring lever 27 as a second developer supplying member which is rotated to supply toner to toner supplying roller 34 as a first developer supplying member; developing roller 33 as a developer carrier to hold toner; toner supplying roller 34 which supplies toner to developing roller 33; and developing blade 35 as a developer layer control member which controls the layer of the toner supplied onto the developing roller 33, i.e., a thin toner layer having a constant thickness. In this case, development by a single component developing method is performed in developing unit 30, thus non-magnetic single component developer is used for the aforementioned toner.

The cleaning device is made of an elastic body, and is disposed to make its edge contact with the surface of photoconductive drum 31Bk with a predetermined pressure, and includes cleaning blade 36 as a second cleaning member to scrape off the toner on photoconductive drum 31Bk; auger (or spiral member) 38 which transports the toner scraped off by cleaning blade 36 as waste toner; and waste toner transport path to supply the waste toner transported by auger 38 to waste toner storage container 39.

Photoconductive drum 31Bk is an OPC drum formed of an organic material and charged to a negative polarity, and includes two layers of a charge generation layer (CGL) and a charge transport layer (CTL). The thickness of the combined layers of the charge generation layer (CGL) and the charge transport layer (CTL) is set to 20 [μm]. If the surface of photoconductive drum 31Bk wears out due to contact with cleaning blade 36 to a reduced thickness of 10 [μm] or less, the performance of photoconductive drum 31Bk decreases. Photoconductive drum 31Bk has a hollow structure and rotation shaft 31*a*Bk is inserted therein.

In developing roller 33, for example, the outer circumference of its metallic shaft 33*a* composed of, for example, stainless steel, is provided with elastic layer 33*b* formed by adding carbon black as a conducting agent to urethane rubber. The rubber hardness (Asker C) of the elastic layer is set to about 77 [°], and surface roughness Rz (10 points average roughness) of the elastic layer is set to about 4 [mum].

The outer diameter of photoconductive drum 31Bk is 30 [mm], the outer diameter of developing roller 33 is 16 [mm], the circumferential speed of photoconductive drum 31Bk is 178 [mm/sec], the circumferential speed of developing roller 33 is 224.28 [mm/sec], thus the ratio of the circumferential speed of developing roller 33 to that of photoconductive drum 31Bk, i.e., the circumferential speed ratio, is 1.26. Although only the description of image forming unit 16Bk has been given, the structures of image forming units 16Y, 16M, 16C are similar thereto.

If the value of the circumferential speed ratio is small, toner cannot be sufficiently charged and its charging characteristic is reduced, thus background fog occurs. On the other hand, if the value of the circumferential speed ratio is large, toner is excessively charged, thus dirt and the like occurs. Therefore, in general, the circumferential speed ratio is preferably set in a range of 1.1 or more and 1.5 or less.

Also, toner supplying roller 34 is made of elastic body foam as a foam such as silicone rubber, urethane rubber, and the like, such that toner supplying roller 34 has therein multiple cells (not shown) some of which are exposed to the surface of toner supplying roller 34 and forming a concave portion on the surface of toner supplying roller 34.

Next, operations of image forming unit 16Bk are described.

First, the surface of photoconductive drum 31Bk uniformly charged by charging roller 32 is exposed by LED head 22Bk, and thus an electrostatic latent image is formed on the surface of photoconductive drum 31Bk. The electrostatic latent image is developed by the toner supplied from developing roller 33 (development), then a toner image is formed on photoconductive drum 31Bk.

Shutter 42 is rotated to open toner supply port 44 in toner cartridge 41 and a predetermined amount of toner in toner cartridge 41 falls and is supplied into developing unit 30 through toner supply port 44. In developing unit 30, the toner is stirred as stirring member 28 is rotated, and is supplied to toner supplying roller 34 by the rotation of toner stirring lever 27. Toner feed roller 34 is rotated in the same direction as developing roller 33 while a constant difference in the circumferential speeds between the rollers is maintained. Accordingly, toner supplying roller 34 supplies toner to developing roller 33 while scraping off excessive toner on the surface of developing roller 33 based on an electric potential difference between toner stirring lever 27 and toner supplying roller 34, and an electric potential difference between toner supplying roller 34 and developing roller 33.

The toner supplied to developing roller 33 is formed into a thin-layer by developing blade 35 as developing roller 33 rotates to form a toner layer with a constant thickness on developing roller 33. Subsequently, the toner on developing roller 33 is transported to an area opposed to photoconductive drum 31Bk, i.e., a development area. Then in the development area, toner is attracted and adheres to a portion on photoconductive drum 31Bk, where an electrostatic latent image is formed, by the electrostatic force of the electrostatic latent image so that a toner image is formed.

Subsequently, the toner image on photoconductive drum 31Bk is transferred to a sheet by transfer roller 21Bk, and the toner remaining on photoconductive drum 31Bk after the transfer is scraped off and removed by cleaning blade 36.

In each image forming unit 16Bk, 16Y, 16M, 16C, to cause the toner from developing roller 33 to adhere to the electrostatic latent image, developing roller 33 is pressed against photoconductive drums 31Bk, 31Y, 31M, 31C with a predetermined pressing force.

If the pressing forces applied in image forming units 16Bk, 16Y, 16M, 16C are the same, the image quality may be degraded. Such degradation of the image quality is caused by a difference, between the color toners, in the mixture ratio of the external additive in the toner.

Specifically, the mixture ratio (the proportion) of the external additive in each color toner is adjusted in accordance with the raw material of each color toner, because the raw materials of the toners are different from each other for each color. Note that the external additive (such as silica) is added in each color toner to provide sufficient fluidity and charging characteristic to each color toner.

For example, in an image forming unit that uses toner with a high proportion of the external additive, the external additive is more likely to remain on the photoconductive drum than in another image forming unit that uses toner with a low proportion of the external additive. Thus, if the cleaning performance of the cleaning blade is adjusted for the image forming unit that uses toner with a high proportion of the external additive, in another image forming unit that uses toner with a low proportion of the external additive, the photoconductive drum is damaged by the cleaning blade.

On the other hand, if the cleaning performance of the cleaning blade is adjusted for the image forming unit that uses toner with a low proportion of the external additive, in another image forming unit that uses toner with a high proportion of the external additive, the external additive remaining on the relevant photoconductive drum cannot be sufficiently removed.

In this case, if the remaining external additive adheres to the surface of the photoconductive drum and thus causes a filming phenomenon, i.e., OPC filming, voids occur in the color image and thereby degrade the image quality.

To prevent the degradation of the image quality, pressing forces between respective developing rollers 33 and photoconductive drums 31Bk, 31Y, 31M, 31C of image forming units 16Bk, 16Y, 16M, 16C are set different in this embodiment. The detail will be described later.

Next, the toner characteristics will be described. A first characteristic of toner is defined by its fluidity, and a second characteristic of toner is defined by its charging characteristic.

Here, fluidity is an indicator of the mobility of toner. For example, if two kinds of toner with different fluidity and a predetermined volume are put into two triangular pyramid shaped containers with a hole formed at their tips, respectively, the toner with higher fluidity flows down through the hole in a short time, while it takes a longer time for the toner with lower fluidity to flow down through the hole.

To measure the fluidity of toner, three sieves 1 to 3 are vertically placed in the increasing order of their coarseness where the coarseness of sieve 1 is set to 335 [mesh], the coarseness of sieve 2 is set to 250 [mesh], and the coarseness of sieve 3 is set to 150 [mesh]. Here, [mesh] is a unit to represent the coarseness of the sieve and is expressed by the number of lines per 1 [inch].

Toner in an amount of 2 [g] is put on the top sieve 1, and is vibrated for 240 [sec] with amplitude of 1 [mm], then the quantity of toner remaining in each sieve 1 to 3 is measured. If the amounts of toner remaining on sieves 1, 2, 3 are represented by M1, M2, M3, respectively, and the aggregation rate of the toner is represented by G, G [%] can be expressed by $G=(M1\times5+M2\times3+M3)\times20/2$. If the fluidity of the toner is represented by H, H [%] can be expressed by $H=100-G$.

Here, charging characteristic is an indicator of the ease of toner charging and is expressed by charge quantity per unit weight.

To measure the toner charging characteristic, a blow off method is generally used, and in the blow off method, toner and carrier for the measurement are mixed and charged with polarities opposite to each other. Then, nitrogen gas is sprayed through the mixture of the toner and carrier to remove the toner only, and the charging characteristic is measured based on the electric charge of the remaining carrier. If the electric charge of the carrier is large, the toner can be easily charged and its charging characteristic is high.

The charging characteristic varies depending on the mixing condition of the toner and carrier, and thus the toner and carrier are fed into a predetermined mixer, and are stirred under a certain stirring condition.

In this embodiment, non-magnetic single component developer is used as the toner to be used for a color printer. To measure the charging characteristic of the toner, the toner is mixed with the carrier used for two-component developer. The carrier is produced by applying resin to magnetic powder such as iron powder.

Next, the relationship between the particle diameter of toner, the toner fluidity H, and the quantity of external additive to adjust the charging characteristic is described. In this case, silica is used as the external additive.

TABLE 1

| Particle diameter of toner | Amount of external additive [wt %] Large silica [50 nm] | Small silica [10 nm] | Large silica 2 [100 nm] | Total [wt %] |
|---|---|---|---|---|
| 8 | 1.9 | 0.6 | 0.1 | 2.6 |
| 5.7 | 1.7 | 0.98 | 0.4 | 3.08 |

In Table 1, silica with the particle diameter of 50 [nm] is referred to as large silica, silica with the particle diameter of 10 [nm] is referred to as small silica, and silica with the particle diameter of 1000 [nm] is referred to as large silica 2.

As shown in Table 1, when the particle diameter of toner becomes small, the toner fluidity H and the charging characteristic are reduced. Thus, to prevent the toner fluidity H and the charging characteristic from decreasing, the proportion of the external additive is increased. In this case, the proportion of the external additive is expressed by the proportion of the external additive weight to the toner weight (weight percent).

Next, a proportion of the external additive to reduce the difference in fluidity H and the charging characteristic between the toner of respective colors is described.

TABLE 2

| Toner | Amount of external additive [wt %] |
|---|---|
| Cyan | 3.1 |
| Magenta | 3.2 |
| Yellow | 3.2 |
| Black | 1.4 |

As shown in Table 2, in order to reduce the difference in fluidity H and the charging characteristic between the toners of respective colors, the amount of the external additives is adjusted for each color toner, and compared with the proportion of the external additive for yellow, magenta, and cyan toner as color toner, the proportion of the external additive for black toner is reduced.

As described above, in a state of base toner forming the toner, even if there is a difference in fluidity H and the charging characteristic between the toners of respective colors, the difference can be reduced by adjusting the proportion of the external additive.

Next, cleaning performance which represents how easily the toner can be scraped off to remove the remaining toner on photoconductive drums 31Bk, 31Y, 31M, 31C is described.

For example, the external additive, when coming off from the toner, gives negative electric charge to the toner, and at this point, the external additive that has come off is positively charged. Thus, the external additive may adhere to some portions of photoconductive drums 31Bk, 31Y, 31M, 31C, the portions having high negative electric potential.

However, the maximum particle diameter of the external additive is 100 [nm], and thus the external additive is extremely fine. Consequently, when remaining toner on photoconductive drums 31Bk, 31Y, 31M, 31C is removed by cleaning blade 36 after transfer, the external additive adhering to photoconductive drums 31Bk, 31Y, 31M, 31C may not be able to be removed. Then, the remaining external additive is fused to the surfaces of photoconductive drums 31Bk, 31Y, 31M, 31C, and causes OPC filming. As a result, voids occur in the color image, and thus the quality of the image is degraded.

Also, in color printers provided in recent years, image maintenance, i.e., prevention of image quality degradation is highly needed, and in many color printers, when low coverage printing (for example, low duty printing of 5 [%] or less image coverage for A4 size sheet) is performed, toner is discarded as needed in developing unit 30. That is to say, in low coverage printing, because the toner which has not been used to form a toner image is repeatedly circulated through the inside of developer 30, the external additive comes off from the toner, and the charging characteristic of the toner is decreased, and thus grayness, fog, etc. occurs and the image quality is degraded.

Thus, in the color printer, for a predetermined cycle, for example, between a sheet and the next sheet in continuous printing, by making the toner adhere to transfer belt 17, and scraping it off by cleaning blade 25 to collect the toner in waste toner box 26, the toner is discarded from image forming units 16Bk, 16Y, 16M, 16C so that the charging characteristic of the toner is maintained. However, because the lifetime of transfer belt 17 is long, and its replacement cycle is long, the quantity of toner collected in waste toner box 26 until transfer belt 17 replaced is large. Consequently, the size of waste toner box 26 needs to be increased, and accordingly, the color printer is also increased in size.

Now, in this embodiment of the invention, for a predetermined cycle, for example, between a sheet and the next sheet in continuous printing, the toner is made to adhere to photoconductive drums 31Bk, 31Y, 31M, 31C as well, and is scraped off by cleaning blade 36 and then the toner is sent to waste toner storage container 39 of toner cartridge 41.

In this case, because the replacement cycle of toner cartridge 41 is shorter than that of transfer belt 17, the size of waste toner storage container 39 does not need to be increased, and cleaning blade 36 scrapes off the remaining toner on photoconductive drums 31Bk, 31Y, 31M, 31C after the transfer, and discarded toner from image forming units 16Bk, 16Y, 16M, 16C.

The toner to be discarded needs to be sent to waste toner storage container 39 of toner cartridge 41 and to be collected. Therefore, a voltage is not applied to transfer rollers 21Bk, 21Y, 21M, 21C, and toner is prevented from adhering to transfer belt 17.

Therefore, the quantity of the toner adhering to photoconductive drums 31Bk, 31Y, 31M, 31C is increased, and the load applied to cleaning blade 36 is increased in order to remove the toner adhering to photoconductive drums 31Bk, 31Y, 31M, 31C. Consequently, cleaning blade 36 needs to be selected in consideration of strength and durability, and also its pressure condition to photoconductive drums 31Bk, 31Y, 31M, 31C needs to be set.

Selecting cleaning blade 36 and setting its pressure condition to photoconductive drums 31Bk, 31Y, 31M, 31C, may be an effective way to effectively scrape off each color toner adhering to photoconductive drums 31Bk, 31Y, 31M, 31C to prevent OPC filming from occurring.

In this case, in order to prevent OPC filming from occurring, it is essential to prevent the external additive with a small particle diameter such as silica from passing through cleaning blade 36. Thus, it is necessary to reduce abrasion of cleaning blade 36, and to prevent a contact portion of cleaning blade 36 with photoconductive drums 31Bk, 31Y, 31M, 31C from chipping to prevent the external additive from passing through a portion which has been chipped, i.e., a chipped portion.

From the above, it has been found that in order to prevent OPC filming from occurring, the pressure applied to cleaning blade 36 against photoconductive drums 31Bk, 31Y, 31M, 31C, i.e., linear pressure is preferably small.

On the other hand, in order to effectively scrape off remaining each color toner on photoconductive drums 31Bk, 31Y, 31M, 31C, the linear pressure needs to be increased; however, in this case, abrasion of cleaning blade 36 is increased, and the contact portion tends to be chipped so that the external additive is likely to pass through the chipped portion.

In this manner, it is difficult to prevent OPC filming from occurring, and also to effectively scrape off remaining toner on photoconductive drums 31Bk, 31Y, 31M, 31C by selecting cleaning blade 36 and setting a pressure condition thereof to photoconductive drums 31Bk, 31Y, 31M, 31C. Accordingly, in this embodiment cleaning blade 36 is so selected and a pressure condition thereof to photoconductive drums 31Bk, 31Y, 31M, 31C is so set so that, although OPC filming slightly occurs in this embodiment, remaining toner on photoconductive drums 31Bk, 31Y, 31M, 31C can be effectively scraped off.

Even in a situation where the external additive passes through cleaning blade 36, the toner does not pass through cleaning blade 36, and is scraped off and removed from photoconductive drums 31Bk, 31Y, 31M, 31C because the particle diameter of the toner is greater than that of the external additive.

Next, the characteristics of cleaning blade 36 used for image forming unit 16Bk in the embodiment is described.

TABLE 3

| Items | |
|---|---|
| Hardness [Hs] | 74 |
| Young's modulus [kgf/cm$^2$] | 68 |
| Repulsion elasticity | 34 |
| 300 [%] Modulus [kgf/cm$^2$] | 240 |
| Permanent elongation | 2.6 |
| Thickness [mm] | 1.7 |
| Free-edge length [mm] | 7.50 |
| I/T | 4.41 |
| Bite amount [mm] | 0.79 |
| Mounting angle [°] | 19.94 |
| Cleaning angle [°] | 10.89 |
| Included angle [°] | 9.05 |
| Contact pressure [gf/cm] | 15.6 |

In Table 3, 300 [%] modulus represents a tensile stress when a stretch factor is set to 300 [%]. Also, I/T is a value obtained by dividing the free-edge length by the thickness.

In order to enhance the cleaning performance for toner, its cleaning angle is preferably set to 10 [°] or more. If the repulsion elasticity coefficient has an excessively large value, abrasion of cleaning blade 36 is increased, and the cleaning performance for toner is lowered, thus the repulsion elasticity coefficient is preferably set to 40 [%] or less.

Although cleaning blade 36 is used as a cleaning member in the embodiment, a cleaning roller such as a fur brush can be used as a cleaning member.

Next, cleaning performance for external additive when the color printer in the above-mentioned configuration is used is verified. In the embodiment, occurrence conditions for OPC filming are compared between image forming unit 16Bk and image forming unit 16C of image forming units 16Y, 16M, 16C that have proportions of the external additive different with each other. The occurrence conditions for OPC filming in image forming units 16Y, 16M, 16C are similar because toner fluidity H and charging characteristics in image forming units 16Y, 16M, 16C are relatively similar to each other.

Figure 4:
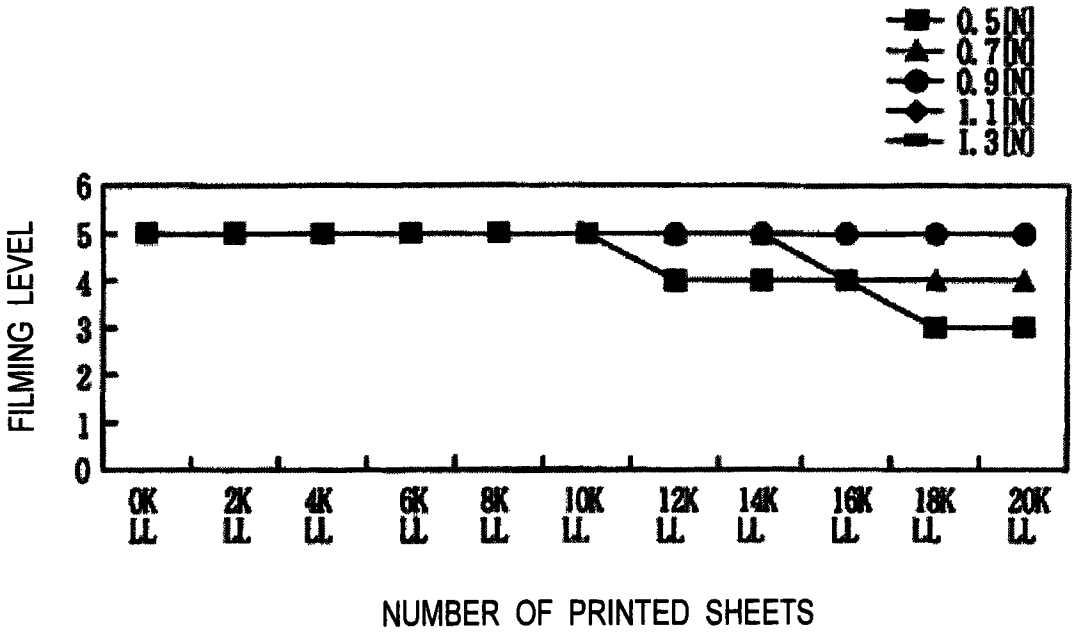
FIG. 4 is a diagram showing an occurrence condition of OPC filming in an image forming unit for black in the first embodiment of the invention.
Figure 5:
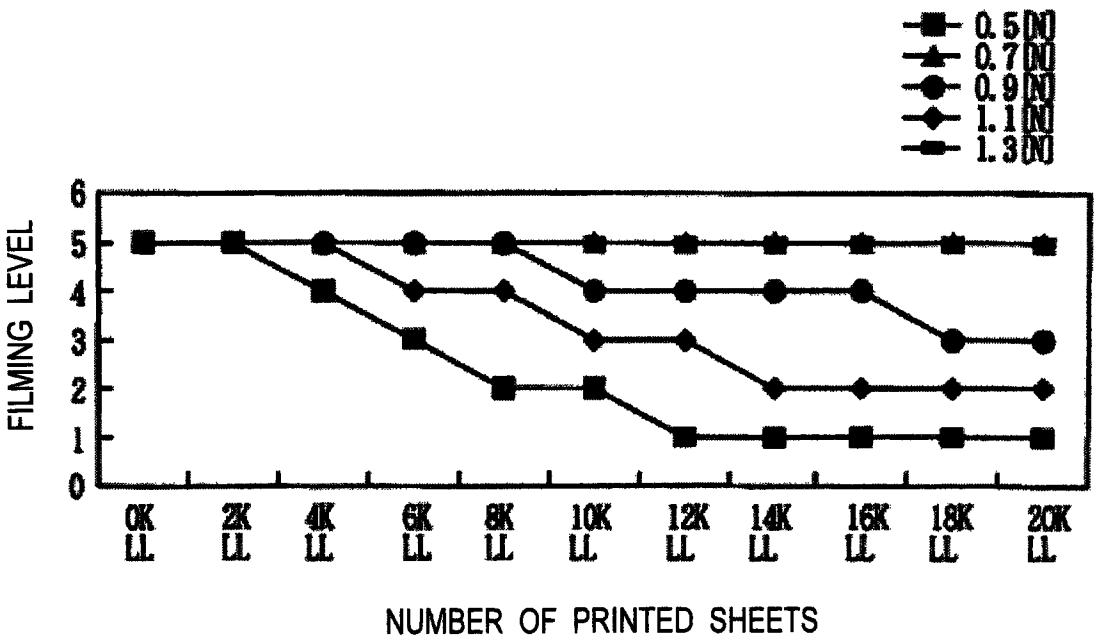
FIG. 5 is a diagram showing an occurrence condition of OPC filming in an image forming unit for cyan in the first embodiment of the invention.

FIG. 4 is a diagram showing an occurrence condition for OPC filming in black image forming unit in the first embodiment of the invention, and FIG. 5 is a diagram showing an occurrence condition for OPC filming in cyan image forming unit in the first embodiment of the invention. In the figure, the horizontal axis represents the number of printed sheets, and the vertical axis represents filming level. The letter LL below the number of printed sheets indicates that the printing is performed in a low temperature and low humidity environment.

In this case, occurrence conditions for OPC filming have been observed for the case where the pressing force between developing roller 33 and photoconductive drum 31Bk, and between developing roller 33 and photoconductive drum 31C (NIP pressure) is varied in the sequence of 0.5 [N], 0.7 [N], 0.9 [N], 1.1 [N], and 1.3 [N].

Also, continuous printing of 20000 A4 size sheets is performed by the color printer under the LL environment of temperature 10 [°] and humidity 20 [%] with 5 [%] of image printing density, in longitudinal feed direction at 30 [ppm (printed number of pages per 1 [minute])] (sheet transport speed is 178 [mm/sec]) of printing speed. The characteristic of cleaning blade 36 is set as shown in Table 3.

For the filming level, level assignment is performed according to the reference table of Table 4.

TABLE 4

| Filming level | Condition |
|---|---|
| 5 | No void occurs |
| 4 | Voids of 0.5 [mm] or less partially occur |
| 3 | Voids of 0.5 [mm] or less occur over the 50 [%] or more area of the entire image |
| 2 | Voids of 0.5 [mm] or more and 2 [mm] or less occur all over the image |
| 1 | Voids larger than 2 [mm] occur all over the image |

That is to say, the filming level is defined to be 5 if no void occurs when printing is performed with the image coverage of 100 [%]. The filming level is defined to be 4 if voids of 0.5 [mm] or less partially occur. The filming level is defined to be 3 if voids of 0.5 [mm] or less occur over the 50 [%] or more area of the entire image. The filming level is defined to be 2 if voids of 0.5 [mm] or more and 2 [mm] or less occur all over the image. The filming level is defined to be 1 if voids larger than 2 [mm] occur all over the image.

As shown in the diagram, black image forming unit 16Bk has more favorable occurrence conditions for OPC filming than cyan image forming unit 16C, and the printed numbers of sheets until OPC filming occurs are different.

This is because the proportion of the external additive in the black toner is less than that in the cyan toner. The reason why the black toner has less proportion of the external additive is because the performance of the charge control agent of the black toner is high, and also the black base toner is more easily charged than the cyan base toner.

Black toner needs no translucency, and thus more options for charge control agents are available. Therefore, a charge control agent having a high performance can be selected.

For yellow, magenta, and cyan toner, salicylic acid zinc is used as a charge control agent, and for black toner, dye containing a complex of ferrous material, for example, quarternary ammonium salt compound, nigrosine series compound, aluminum, iron, chromium, and triphenylmethane series pigment, are used as charge control agents.

As described above, photoconductive drums 31Bk, 31Y, 31M, 31C and their respective developing rollers 33 have different circumferential speeds and photoconductive drums 31Bk, 31Y, 31M, 31C are constantly rubbed against by respective developing rollers 33, and thus at the contact position of photoconductive drum 31Bk and developing roller 33, the external additive adhering to the surface of photoconductive drum 31Bk can be scraped off. Accordingly, as the pressure applied to photoconductive drums 31Bk, 31Y, 31M, 31C by developing roller 33 increases, the occurrence of OPC filming can be suppressed more.

However, if the pressure is increased, frictional force between photoconductive drums 31Bk, 31Y, 31M, 31C and their respective developing rollers 33 is increased, and accordingly, so is the electric potential of the toner on developing roller 33, i.e., the toner potential is increased even in the same type of toner, and charge amount of the toner is increased. When the charge amount of the toner is increased to the point where the toner layer on developing roller 33 cannot be controlled by using developing blade 35 so as to have a certain thickness, a large amount of toner locally adheres on the image, and thus the image is contaminated.

Next, a situation where the toner potential is increased, and a large amount of toner locally adheres on the image is described.

If low coverage printing is performed with less toner on image forming units 16Bk, 16Y, 16M, 16C, a smaller amount of toner is consumed, thus the toner not used to form a toner image is repeatedly charged between developing roller 33 and developing blade 35, and accordingly, the toner potential is increased.

Especially, when continuous printing is performed, the outer diameter of toner supplying roller 34 is reduced, and the toner on developing roller 33 collected from photoconductive drum 31Bk cannot be sufficiently scraped off by toner supplying roller 34, and thus the toner potential is further increased.

Next, the relationship between the number of printed sheets and the toner potential when printing with image forming units 16Bk, 16C is described.

Figure 6:
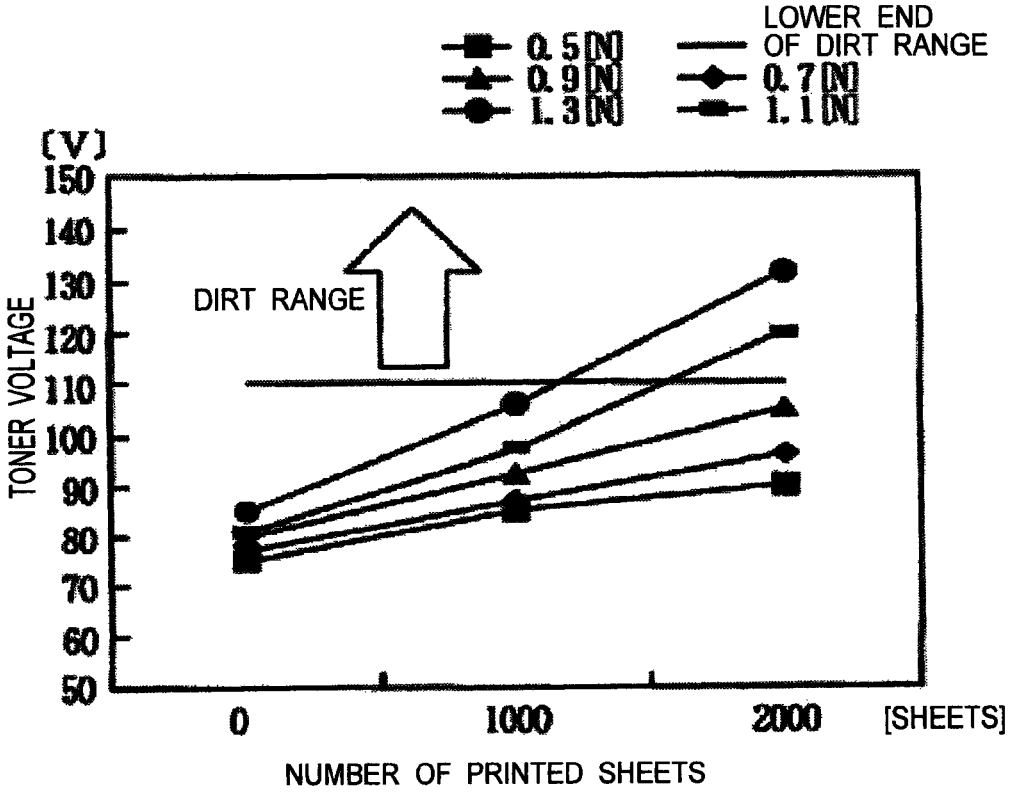
FIG. 6 is a diagram showing a relationship between the number of printed sheets and a toner electrical potential when printing is performed by the image forming unit for black in the first embodiment of the invention.
Figure 7:
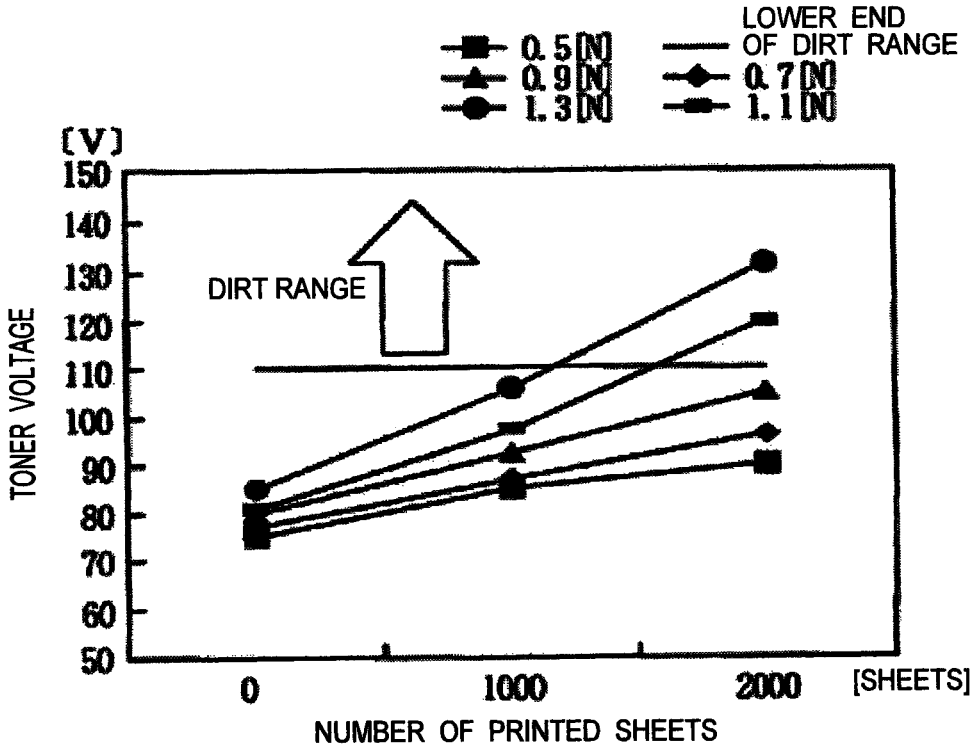
FIG. 7 is a diagram showing a relationship between the number of printed sheets and a toner electrical potential when printing is performed by the image forming unit for cyan in the first embodiment of the invention.

FIG. 6 is a diagram showing the relationship between the number of printed sheets and the toner potential when printing with the black image forming unit in the first embodiment of the invention. FIG. 7 is a diagram showing the relationship between the number of printed sheets and the toner potential when printing with the cyan image forming unit in the first embodiment of the invention. In FIG. 7, the horizontal axis represents the number of printed sheets, and the vertical axis represents toner potential.

In this case, the toner potential on developing roller 33 has been observed for the case where continuous printing of 2000 sheets is performed with a low coverage while a pressing force (NIP pressure) between developing roller 33 and photoconductive drum 31Bk, and between developing roller 33 and photoconductive drum 31C is varied in the sequence of 0.5 [N], 0.7 [N], 0.9 [N], 1.1 [N], and 1.3 [N].

The toner potential has been measured by using a non-contact surface potential meter ("Model 344" manufactured by TREK) with its probe placed closer to the toner with the shaft of developing roller 33 grounded.

In image forming unit 16Bk, as shown in FIG. 6, if the pressing force is 1.3 [N], the toner potential of black, which is 85 [V] at the start of printing, is increased to 132 [V] after performing continuous printing of 2000 sheets. If the pressing force is 1.1 [N], the toner potential of black, which is 81 [V] at the start of printing, is increased to 120 [V] after performing continuous printing of 2000 sheets. These increased toner potentials exceed toner potential 110 [V], the lower limit of dirt occurrence range in which dirt occurs in the image. Therefore, the upper limit of the pressing force for black is 0.9 [N].

In image forming unit 16C, as shown in FIG. 6, if the pressing force is 1.3 [N], the toner potential of black, which is 55 [V] at the start of printing, is increased to 115 [V] after performing continuous printing of 2000 sheets. This increased toner potential exceeds toner potential 110 [V], which is the lower limit of dirt occurrence range, in which dirt occurs in the image. Therefore, the upper limit of the pressing force for cyan is 1.1 [N].

As shown in these printed results, even if the same pressing forces are applied to respective developing rollers 33 against photoconductive drums 31Bk, 31Y, 31M, 31C, the toner potentials for black and cyan are different. Also, as shown in FIG. 7, even if the proportion of the external additive is adjusted between black toner and cyan toner (color toner) so that the proportion of the external additive in black toner is less than that in cyan toner, the charging characteristic of black toner is still higher than that of cyan toner.

This is because the difference in the charging characteristics of the base toner between the colors cannot be reduced by adjusting the proportion of the external additive.

That is to say, as described above, in order to reduce the difference in the charging characteristics between the toner of respective colors, the proportion of the external additives is adjusted for each color toner. However, in each of image forming units 16Bk, 16Y, 16M, 16C, for example, due to the friction between developing roller 33 and toner supplying roller 34, and the friction between developing roller 33 and developing blade 35, the external additive may be separated from the base toner, or the external additive may be buried in the base toner, and thus the quantity of the external additive present on the surface of the base toner may be decreased. In this case, the contribution of the charging characteristic of the base toner among the toners for each color is increased, and the charging characteristic varies for each type, e.g., color of toner. The charging characteristic of black base toner is higher than that of cyan base toner, as described above, and thus the charging characteristic of black toner is higher than that of cyan toner.

Next, background fog is described.

Background fog is color dirt caused on non-image areas of a sheet by the toner adhering on photoconductive drums 31Bk, 31Y, 31M, 31C.

In this case, a color difference is used as an indicator showing degree of background fog, and the greater the color difference, the greater the background fog, and lower the quality of the image. A target color difference in the embodiment is a certain value of color dirt of non-image area on the sheet, in such a degree that cannot be visually recognized in the measurement of background fog.

Next, the measurement method for background fog is described.

First, no image printing is performed, i.e., a sheet is passed through the transport path in the color printer without forming any image, then a predetermined tape is attached to photoconductive drums 31Bk, 31Y, 31M, 31C to collect any toner adhering thereto. Subsequently, the tape is attached to a blank sheet to measure color difference E1. Subsequently, color difference E2 of the tape itself (the tape before attaching to photoconductive drums 31Bk, 31Y, 31M, 31C) is measured, and by subtracting color difference E2 from color difference E1, color difference δE of the toner adhering to photoconductive drum 31Bk is calculated: δE=E1−E2, the background fog can be numerically determined. As measuring instrument to measure color differences E1 and E2, CM-2600D manufactured by Konica Minolta Co., Ltd. is used.

Next, the relationship between the pressing force and the color difference is described.

Figure 8:
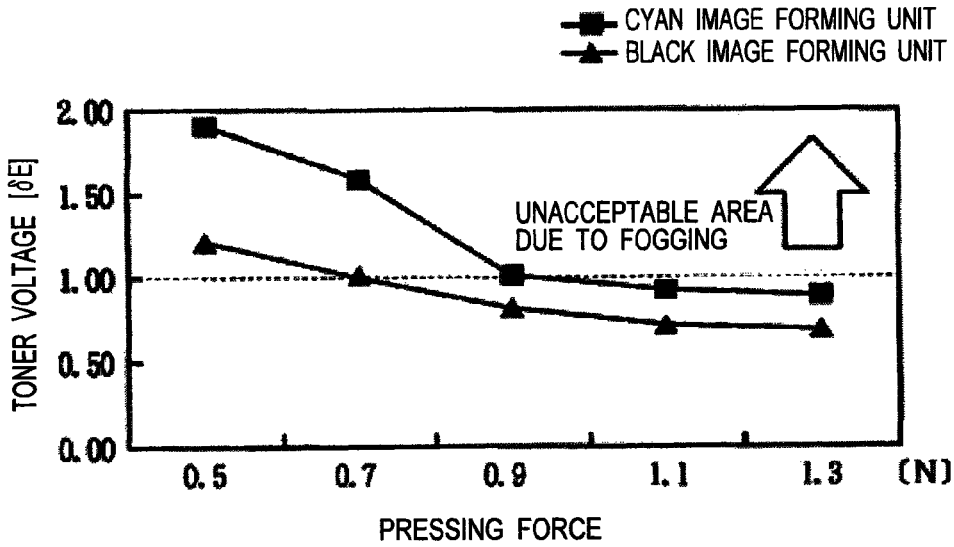
FIG. 8 is a diagram showing a relationship between pressing force and a color difference in the first embodiment of the invention.

FIG. 8 is a diagram showing the relationship between the pressing force and the color difference in the first embodiment of the invention. In the figure, the horizontal axis represents pressing force, and the vertical axis represents color difference.

As shown in FIG. 8, in either of image forming units 16Bk and 16C, if the pressing force is increased, the toner potential is increased, and the quantity of toner stagnating on developing roller 33 without being charged is decreased. Thus, color difference δE is reduced and the background fog is decreased.

Subsequently, the result of general evaluation for image forming units 16Bk, 16Y, 16M, 16C based on the occurrence conditions for background fog, dirt, and OPC filming is shown in Table 5.

TABLE 5

| | Pressing force | Background fog | Dirt | OPC filming | General evaluation |
|---|---|---|---|---|---|
| Cyan image forming unit | 0.5 | x | ○ | x | x |
| | 0.7 | x | ○ | x | x |
| | 0.9 | Δ | ○ | x | x |
| | 1.1 | ○ | ○ | ○ | ○ |
| | 1.3 | ○ | x | ○ | x |
| Magenta image forming unit | 0.5 | x | ○ | x | x |
| | 0.7 | x | ○ | x | x |
| | 0.9 | x | ○ | Δ | x |
| | 1.1 | Δ | ○ | ○ | Δ |
| | 1.3 | ○ | ○ | ○ | ○ |
| | 1.5 | ○ | x | ○ | x |
| Yellow image forming unit | 0.5 | x | ○ | x | x |
| | 0.7 | x | ○ | x | x |
| | 0.9 | x | ○ | Δ | x |
| | 1.1 | Δ | ○ | ○ | Δ |
| | 1.3 | ○ | ○ | ○ | ○ |
| | 1.5 | ○ | x | ○ | x |
| Black image forming unit | 0.5 | x | ○ | x | x |
| | 0.7 | Δ | ○ | Δ | Δ |
| | 0.9 | ○ | ○ | ○ | ○ |
| | 1.1 | ○ | x | ○ | x |
| | 1.3 | ○ | x | ○ | x |

As shown in Table 5, optimal pressing force in each of image forming units 16Bk, 16Y, 16M, 16C is as follows. Optimal pressing force in image forming unit 16C is 1.1 [N], optimal pressing force in image forming unit 16M and 16Y is 1.3 [N], and optimal pressing force in image forming unit 16Bk is 0.9 [N].

That is to say, it can be seen that optimal pressing force in image forming unit 16Bk is smaller than those in image forming units 16Y, 16M, 16C.

In this manner, optimal pressing force in image forming units 16Bk, 16Y, 16M, 16C is varied depending on the toner used for image forming units 16Bk, 16Y, 16M, 16C, and thus by setting the pressing force therein according to the toner, for example, for the type, and characteristics of the toner, the charging characteristic at the time of image formation can be stabilized between toner of the colors, and thus the image quality of the color printer can be improved.

Next, a measurement method for pressing force is described.

Figure 9:
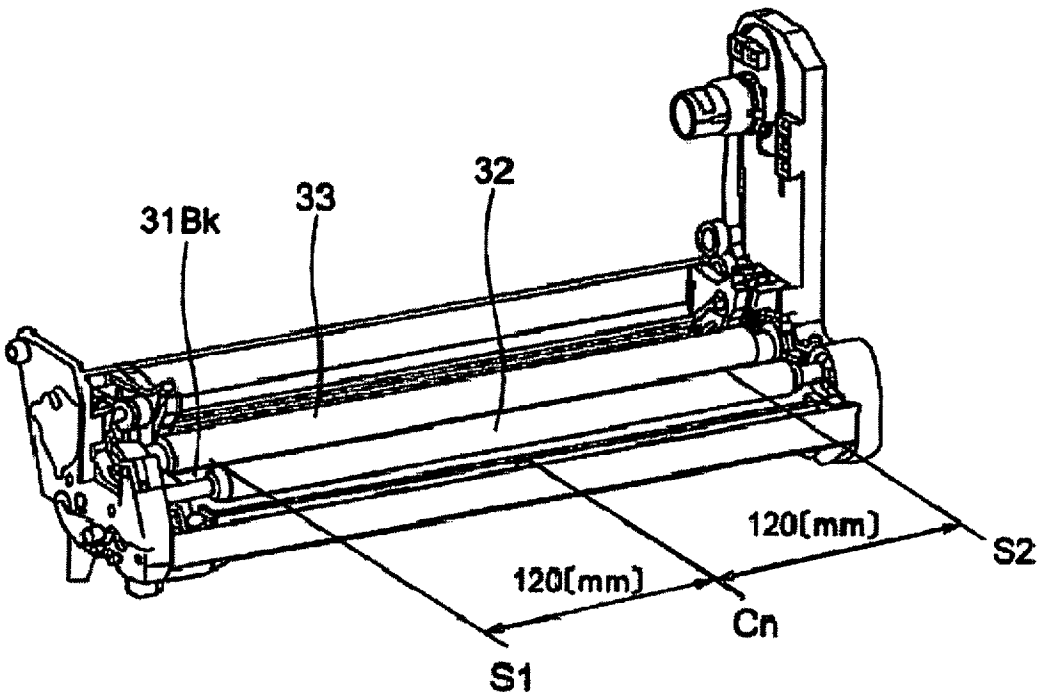
FIG. 9 is a diagram illustrating a measurement position for the pressing force in the first embodiment of the invention.
Figure 10:
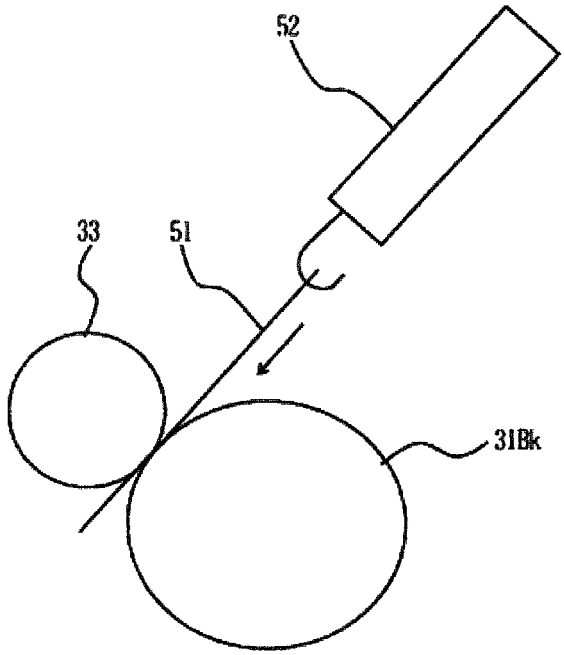
FIG. 10 is a diagram showing a measurement method for the pressing force in the first embodiment of the invention.

FIG. 9 is a diagram illustrating the measurement position of the pressing force in the first embodiment of the invention. FIG. 10 is a diagram showing a measurement method for the pressing force in the first embodiment of the invention.

In FIG. 9, component 31Bk is the photoconductive drum, component 32 is the charging roller, and component 33 is the developing roller. In the embodiment, at positions S1 and S2 each being 120 [mm] away from the center Cn in a longitudinal direction of photoconductive drum 31Bk, pressing forces are measured while photoconductive drum 31Bk, charging roller 32, developing roller 33 are rotating.

The reason why pressing forces are measured while photoconductive drum 31Bk, charging roller 32, developing roller 33 are rotating is because the pressing force on the side where the drive gear of photoconductive drum 31Bk is disposed tends to be smaller than on the side where the same is not disposed because a helical gear is used for the drive gear of photoconductive drum 31Bk.

To measure pressing force, image forming unit 16Bk is mounted on a rotating jig, and photoconductive drum 31Bk is rotated with a constant rotation speed, and then, as shown in FIG. 10, pressing force measurement film 51, whose one end is set free and the other end is supported by tension gauge 52, is inserted into the contact position of photoconductive drum 31Bk and developing roller 33.

At this point, along with the rotation of photoconductive drum 31Bk and developing roller 33, pressing force measurement film 51 is pulled in the arrow direction and thereby pulling pull tension gauge 52. Subsequently, photoconductive drum 31Bk and developing roller 33 rotate while sliding on pressing force measurement film 51, and thus the value of tensile force displayed on tension gauge 52 at this point is the pressing force. Pressing force measurement film 51 is a PET film having a thickness is 0.1 [mm] and a width of 10 [mm].

Next, an adjustment method for pressing force is described.

Figure 11:
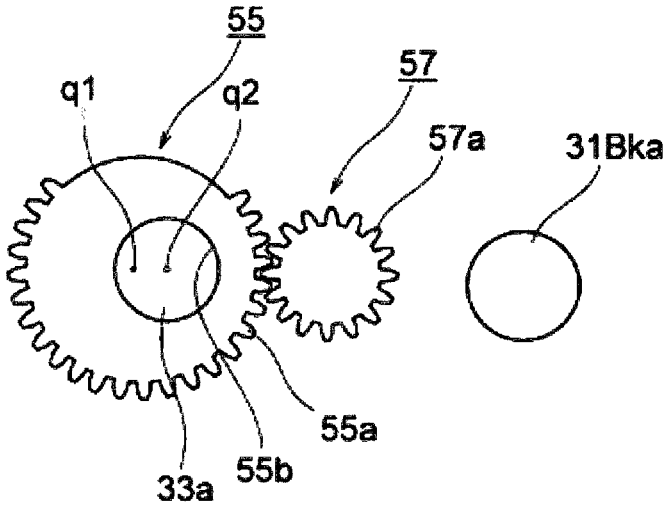
FIG. 11 is a diagram showing a first state of the pressing force adjustment mechanism in the first embodiment of the invention.
Figure 12:
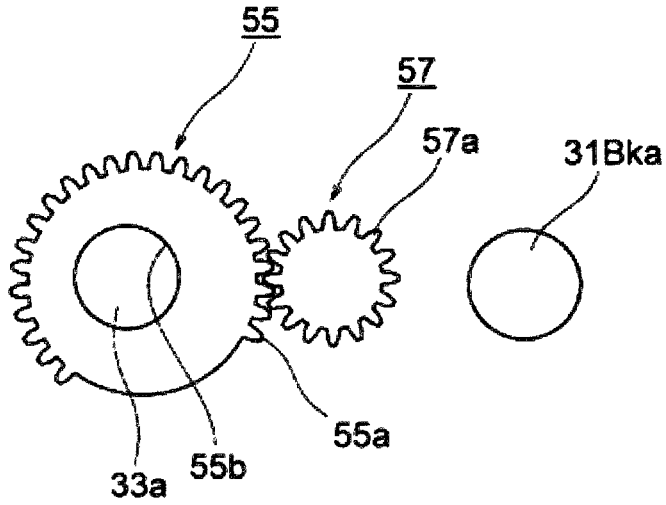
FIG. 12 is a diagram showing a second state of the pressing force adjustment mechanism in the first embodiment of the invention.

FIG. 1 is a diagram of a pressing force adjusting mechanism of the first embodiment of the invention. FIG. 11 is a diagram of a pressing force adjusting mechanism of the first embodiment of the invention in a first state. FIG. 12 is a diagram of a pressing force adjusting mechanism of the first embodiment of the invention in a second state.

In the figure, component 23 is a mold of the exterior of image forming unit 16Bk, component 31Bk is a photoconductive drum, component 31Bka is the rotation axis of photoconductive drum 31Bk, component 33 is a developing roller, and component 33*a* is an axis of the developing roller 33. Axis 33*a* is rotatably supported by developing roller shaft receptacle 55 as a first bearing member and as a cam, and developing roller shaft receptacle 55 is rotatably supported by bearing supporter 56 as a second bearing member formed in mold 23.

Developing roller shaft receptacle 55, which is formed of an annular body, includes gear 55*a* on its peripheral surface, and hole 55*b* to support axis 33*a*, where center q1 of the circle defining the peripheral surface is displaced from center q2 of hole 55*b* by a predetermined distance of 0.15 [mm] in the embodiment. In the embodiment, gear 55*a* is configured to be formed in a predetermined range in a circumferential direction of developing roller shaft receptacle 55, however gear 55*a* may be formed over the entire range in a circumferential direction of developing roller shaft receptacle 55.

Also, in order to rotate developing roller shaft receptacle 55, gear 55*a* and gear 57*a* of adjusting member 57 are engaged with each other.

When developing roller shaft receptacle 55 is rotated by rotating adjusting member 57, a hole 55*b* is moved in the direction coming close or away from adjusting member 57, and accordingly, axis 33*a* is moved in the direction close or away from rotation axis 31Bka. Thus, by changing the distance between axis 33*a* and rotation axis 31Bka, the pressing force of developing roller 33 against photoconductive drum 31Bk can be changed.

For example, in FIG. 11, axis 33*a* is placed at a position closest to rotation axis 31Bka, the distance between axis 33*a* and rotation axis 31Bka, i.e., inter-axis distance is set to 29.65 [mm], and the pressing force is set to its maximum of 1.5 [N].

Also, in FIG. 12, axis 33*a* is placed at a position most remote from rotation axis 31Bka, the inter-axis distance is set to 29.95 [mm], and the pressing force is set to its minimum of 0.4 [N].

Thus, by rotating adjusting member 57, the inter-axis distance can be adjusted in the range of 29.65 [mm] or more and 29.95 [mm] or less, and accordingly, the pressing force can be varied in the range of 0.4 [N] and 1.5 [N].

In this manner, in the embodiment, the pressing force is set according to the toner used in each of image forming units 16Bk, 16Y, 16M, 16C, i.e., set according to the charging characteristic of the toner, the type of toner, raw material of toner, the characteristic of the toner, the proportion of the external additive to toner, particle diameter of toner, and fluidity of toner, so that developing roller 33 presses photoconductive drums 31Bk, 31Y, 31M, 31C with the set pressing force, and thus the image quality can be improved.

That is to say, in image forming units 16Bk, 16Y, 16M, 16C, which use toner made of raw material that is different for each color, the proportion of the external additive to the toner is adjusted according to each raw material, the pressing force of developing roller 33 against photoconductive drums 31Bk, 31Y, 31M, 31C is modified for each of image forming units 16Bk, 16Y, 16M, 16C, and thus cleaning performance of cleaning blade 36 needs no adjustment. Accordingly, in an image forming unit which uses toner having a high mixture ratio of the external additive, damaging photoconductive drum by cleaning blade 36 can be avoided.

In an image forming unit that uses toner with a high mixture ratio of the external additive, the remaining amount of external additive on each photoconductive drum can be suppressed. Accordingly, OPC filming due to remaining external additive adhering to the surface of the photoconductive drum can be avoided, and thus occurrence of voids on color image as well as background fog and dirt can be prevented. As a result, the image quality can be improved.

In the first embodiment, as shown in Table 5, in order to improve image quality, in image forming units 16M, 16C for magenta and cyan, it is necessary to generate pressing force greater than that in image forming unit 16Bk, 16Y for black and cyan.

However, if the pressing force is excessively increased, developing roller 33 is worn out and the lifetime of each of image forming units 16M, 16C is reduced.

[Second Embodiment]

Next, a second embodiment of the invention is described, in which by setting the hardness of developing roller 33 according to the toner used for image forming units 16Bk, 16Y, 16M, 16C, wearing of developing roller 33 can be suppressed, and the lifetime of each of image forming units 16M, 16C can be increased. The component that has the same structure as that in the first embodiment is labeled with the same reference numeral, and the effects of the first embodiment is incorporated as the effects of the invention due to sharing the same structure.

In this case, the hardness of developing roller 33 (rubber hardness) as a developer carrier is 77 [°] Asker C in the first embodiment, while the hardness of developing roller 33 in this embodiment is increased by about 2 [%], i.e., 79 [°] Asker C. Here, the hardness can be increased by increasing cross-linking of urethane rubber which forms developing roller 33.

Next, the relationship between the rubber hardness of developing roller 33 and color difference is described.

Figure 13:
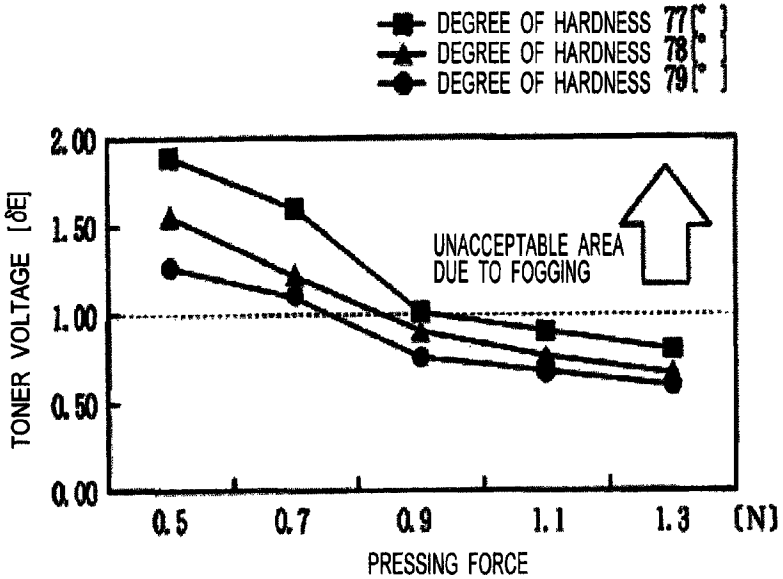
FIG. 13 is a diagram showing a relationship between pressing force and a color difference in a second embodiment of the invention.

FIG. 13 is a diagram showing a relationship between a pressing force and a color difference in the second embodiment of the invention. In the figure, the horizontal axis represents pressing force, and the vertical axis represents color difference.

In this case, as developing roller 33, the ones having hardness of 77 [°], 78 [°], and 79 [°] are used.

Wearing of developing roller 33 can be suppressed by increasing the hardness of developing roller 33, and thus the lifetime of each of image forming units 16M, 16C as an image former can be increased.

Also, the pressing force of developing blade 35 against developing roller 33 as a developer layer control member, i.e., contact pressure and the pressing force of developing roller 33 against photoconductive drums 31Bk, 31Y, 31M, 31C as image carriers are increased. Thus, charge quantity of the toner as a developer can be increased. Accordingly, toner can be prevented from scattering on portions in which an electrostatic latent image as a latent image on photoconductive drums 31Bk, 31Y, 31M, 31C is not formed (i.e., non-image area of a sheet as a medium). As a result, background fog can be prevented from occurring.

Next, the relationship between the pressing force and image quality is described in Table 6.

TABLE 6

| | Pressing force | Background fog | Dirt | OPC filming | General evaluation |
|---|---|---|---|---|---|
| Cyan image | 0.5 | x | ○ | x | x |
| forming unit | 0.7 | x | ○ | x | x |
| (hardness of | 0.9 | ○ | ○ | x | x |
| developing | 1.1 | ○ | ○ | ○ | ○ |
| roller is 79 [°]) | 1.3 | ○ | x | ○ | x |
| Magenta image | 0.5 | x | ○ | x | x |
| forming unit | 0.7 | x | ○ | x | x |
| (hardness of | 0.9 | Δ | ○ | Δ | x |
| developing | 1.1 | ○ | ○ | ○ | ○ |
| roller is 79 [°]) | 1.3 | ○ | ○ | ○ | ○ |
| | 1.5 | ○ | x | ○ | x |

As shown in Table 6, in image forming units 16M, 16C of magenta, cyan, a margin of the pressing force, i.e., the range of the pressing force in which image quality can be maintained, is increased.

[Third Embodiment]

A third embodiment of the invention is described, where by setting the rotation speed of developing roller 33 according to the toner used for image forming units 16Bk, 16Y, 16M, 16C, wearing of developing roller 33 can be suppressed, and the lifetime of each of image forming units 16Bk, 16Y, 16M, 16C can be increased. The component that has the same structure as that in the first embodiment is labeled with the same reference numeral, and the effects of the first embodiment are incorporated as the effects of the invention due to sharing the same structure.

Figure 14:
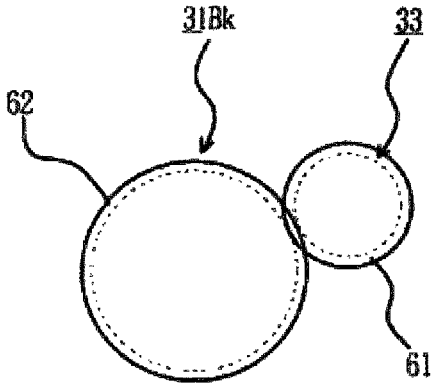
FIG. 14 is a diagram showing a driving system of a photoconductive drum and a developing roller in a third embodiment of the invention.

FIG. 14 is a diagram showing a driving system of a photoconductive drum and a developing roller in a third embodiment of the invention.

In the figure, component 31Bk is a photoconductive drum as an image carrier, component 33 is a developing roller as a developer carrier, component 61 is a developing roller drive gear as a first drive gear, disposed on the same axis as developing roller 33, and component 62 is a photoconductive drum drive gear as a second drive gear, disposed on the same axis as photoconductive drum 31Bk.

As shown in the figure, developing roller drive gear 61 and photoconductive drum drive gear 62 are engaged with each other, as photoconductive drum drive gear 62 is rotated, developing roller 33 receives the rotation of photoconductive drum drive gear 62, then is rotated.

The number of teeth of photoconductive drum drive gear 62 is set to 38. The number of teeth of developing roller drive gear 61 in the embodiment is set to 15, while the number of teeth of the developing roller drive gear of developing roller 33 is set to 16 in the first embodiment.

Accordingly, in this embodiment, the circumferential speed of developing roller 33 of image forming unit 16Bk is set to 240 [mm/sec], and the circumferential speed of developing roller 33 of image forming units 16Y, 16M, 16C is set to 224.28 while the circumferential speed of developing roller 33 of image forming units 16Bk, 16Y, 16M, 16C is 224.28 [mm/sec] in the first embodiment. Thus, in image forming unit 16Bk, compared with image forming units 16Y, 16M, 16C, the circumferential speed difference between photoconductive drum 31Bk and developing roller 33 can be increased. As a result, developing roller 33 can be rubbed against photoconductive drum 31Bk of image forming unit 16Bk, in which the pressing force of developing roller 33 to photoconductive drum 31 is small compared with image forming units 16Y, 16M, 16C, and thus performance of removing the external additive on photoconductive drum 31Bk is improved by developing roller 33.

Next, an occurrence condition of OPC filming of cyan image forming unit 16C is described.

Figure 15:
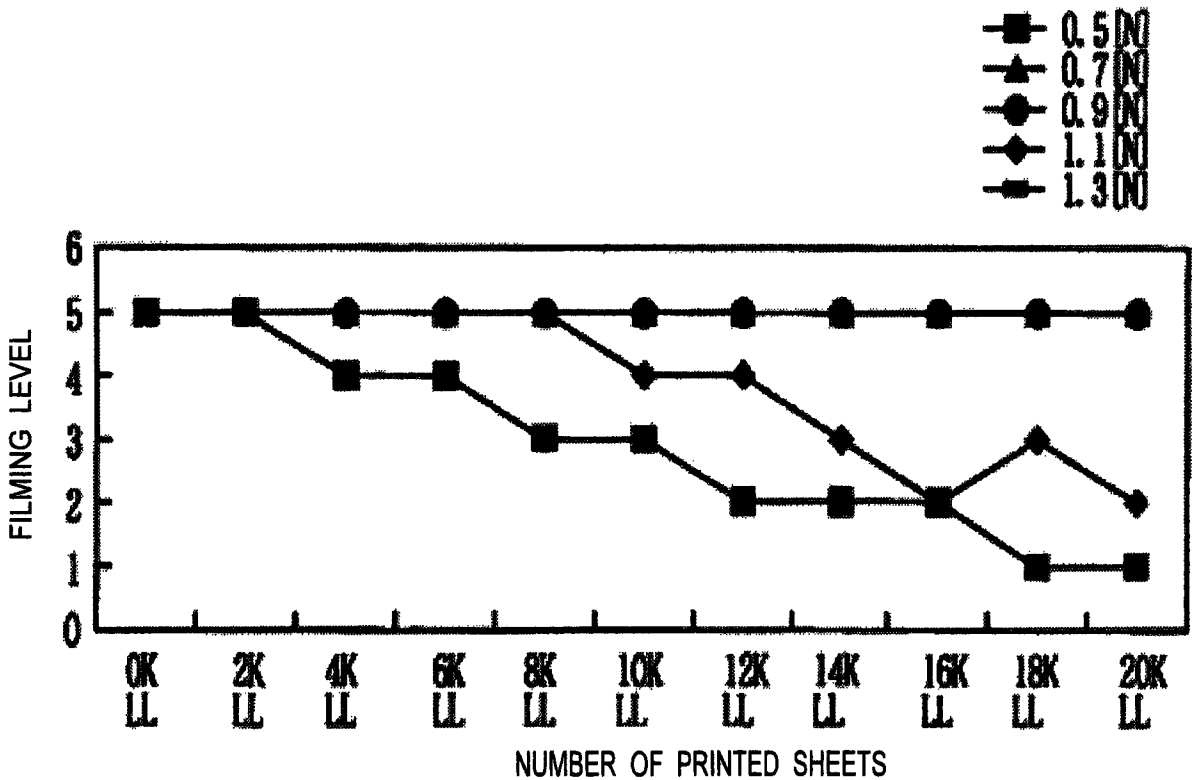
FIG. 15 is a diagram showing an occurrence condition of OPC filming in an image forming unit for cyan in the third embodiment of the invention.

FIG. 15 is a diagram showing an occurrence condition for OPC filming in an image forming unit for cyan of the third embodiment of the invention. In the figure, the horizontal axis represents the number of printed sheets, and the vertical axis represents filming level.

For example, if the pressing force is set to 0.7 [N], in the first embodiment, an occurrence of OPC filming is identified if more than 4000 sheets are printed, while in this embodiment, an occurrence of OPC filming is not identified until more than 8000 sheets are printed.

As such, in this embodiment, occurrence of OPC filming can be suppressed, thus the image quality can be improved.

Next, the relationship between the pressing force and image quality is described in Table 7.

TABLE 7

| | Pressing force | Background fog | Dirt | OPC filming | General evaluation |
|---|---|---|---|---|---|
| Cyan image forming | 0.5 | x | ○ | x | x |
| unit | 0.7 | x | ○ | Δ | x |
| (the number of gear | 0.9 | Δ | ○ | ○ | Δ |
| teeth in developing | 1.1 | ○ | ○ | ○ | ○ |

TABLE 7-continued

| | Pressing force | Background fog | Dirt | OPC filming | General evaluation |
|---|---|---|---|---|---|
| roller is 17) | 1.3 | ○ | x | ○ | x |
| Magenta image | 0.5 | x | ○ | x | x |
| forming unit | 0.7 | x | ○ | Δ | x |
| (the number of gear | 0.9 | x | ○ | ○ | x |
| teeth in developing | 1.1 | Δ | ○ | ○ | ○ |
| roller is 17) | 1.3 | ○ | ○ | ○ | ○ |
| | 1.5 | ○ | x | ○ | x |

As shown in Table 7, in image forming units 16M, 16C of magenta, cyan, a margin of the pressing force, i.e., the range of the pressing force in which image quality can be maintained, is increased.

In each of the above-mentioned embodiments, development by a single component developing method is performed in developing unit 30, and thus toner of non-magnetic single component developer is used as toner as developer; however, in developer 30, development according to two component developing method may be performed, and toner provided with a carrier can be used as toner.

In each of the above-mentioned embodiments, a color printer is described; however, the invention may be applied to a monochrome printer, a copying machine, a facsimile, or a multi-function device.

The invention is not limited to each of the above-mentioned embodiments, and the embodiments can be modified variously based on the spirit of the invention, and those modified are not excluded from the scope of the invention.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. An image forming apparatus comprising:

a first image forming unit including a first image carrier and a first developer carrier in contact with the first image carrier at a first pressing force, and the first developer carrier carries a first developer having a first charging characteristic; and a second image forming unit including a second image carrier, and a second developer carrier in contact with the second image carrier at a second pressing force, greater than the first pressing force, and the second developer carrier carries a second developer having a second charging characteristic, wherein the first pressing force and the second pressing force are set based on the first charging characteristic and the second charging characteristic, respectively.

2. The image forming apparatus according to claim 1, wherein the first developer and the second developer each contain an external additive, and a proportion of the external additive to the first developer is smaller than a proportion of the external additive to the second developer.

3. The image forming apparatus according to claim 1, wherein the first charging characteristic is higher than the second charging characteristic.

4. The image forming apparatus according to claim 1, further comprising:

a first pressing force adjustment mechanism configured to be capable of changing the first pressing force by changing the distance between the first image carrier and the first developer carrier; and a second pressing force adjustment mechanism configured to be capable of changing the second pressing force by changing the distance between the second image carrier and the second developer carrier.

5. The image forming apparatus according to claim 4, wherein the first pressing force adjustment mechanism includes a first cam and the second pressing force adjustment mechanism includes a second cam, the first cam changes the distance between the first image carrier and the first developer carrier by rotation of the first cam and the second cam changes the distance between the second image carrier and the second developer carrier by rotation of the second cam.

6. The image forming apparatus according to claim 1, wherein the hardness of the first developer carrier is smaller than the hardness of the second developer carrier.

7. The image forming apparatus according to claim 6, wherein the first developer carrier and the second developer carrier each include a shaft and an elastic layer provided on the circumferential surface of the shaft.

8. The image forming apparatus according to claim 1, wherein the circumferential speed of the first developer carrier is faster than the circumferential speed of the second developer carrier.

9. An image forming apparatus comprising:

a first image forming unit including a first image carrier and a first developer carrier in contact with the first image carrier at a first pressing force, and the first developer carrier carries a first developer;

a second image forming unit including a second image carrier, and a second developer carrier in contact with the second image carrier at a second pressing force, greater than the first pressing force, and the second developer carrier carries a second developer, wherein the circumferential speed of the first developer carrier is faster than the circumferential speed of the second developer carrier;

a first gear configured to transmit a rotation to the first developer carrier; and a second gear configured to transmit a rotation to the second developer carrier, wherein the number of teeth of the first gear is smaller than the number of teeth of the second gear.

10. The image forming apparatus according to claim 1, further comprising:

the first image forming unit includes a first cleaning blade in contact with the first image carrier and configured to remove the first developer on the first image carrier; and the second image forming unit includes a second cleaning blade in contact with the second image carrier and configured to remove the second developer on the second image carrier.

11. An image forming apparatus comprising:

a first image forming unit including a first image carrier and a first developer carrier in contact with the first image carrier at a first pressing force, and the first developer carrier carries a first developer having a first charging characteristic; and a second image forming unit including a second image carrier, and a second developer carrier in contact with the second image carrier at a second pressing force different from the first pressing force, and the second developer carrier carries a second developer having a second charging characteristic different from the first charging characteristic.

12. The image forming apparatus according to claim 11, wherein the first pressing force is smaller than the second pressing force, and the first charging characteristic is higher than the second charging characteristic.

* * * * *